US005980179A

United States Patent [19]

Hirai

[11] Patent Number: 5,980,179

[45] Date of Patent: Nov. 9, 1999

[54] SCREW WASHER

[75] Inventor: Takashi Hirai, Kobe, Japan

[73] Assignee: Hirai Kosaku Kabushiki Kaisha, Kobe, Japan

[21] Appl. No.: 09/039,452

[22] Filed: Mar. 16, 1998

Related U.S. Application Data

[62] Division of application No. 08/748,735, Nov. 18, 1996, Pat. No. 5,755,133, which is a division of application No. 08/115,010, Sep. 1, 1993, Pat. No. 5,626,521.

[30] Foreign Application Priority Data

Sep. 1, 1992 [JP] Japan ..... 4-233915

[51] Int. Cl.[6] ..... F16B 37/00

[52] U.S. Cl. ..... 411/427; 411/84

[58] Field of Search ..... 411/84, 427, 386, 411/176, 181, 180

[56] References Cited

U.S. PATENT DOCUMENTS 1,990,718 2/1935 Swanstrom ..... 411/427
5,676,510 10/1997 Fischer ..... 411/84

FOREIGN PATENT DOCUMENTS 467199 8/1950 Canada ..... 411/427
2325296 4/1977 France ..... 411/427

*Primary Examiner*—Flemming Saether
*Attorney, Agent, or Firm*—Edwin E. Greigg; Ronald E. Greigg

[57] ABSTRACT

An improved screw washer, and an improved mold for fabricating the improved screw washer. Using a selected metal plate having a thickness thinner than a nominal height demanded for a nut, the invention primarily aims to form an improved screw washer incorporating a nut satisfying the demanded height. The invention is to provide an improved screw washer, and an improved mold for fabricating the screw washer. Particularly, using this improved mold, the improved screw washer can easily be manufactured, where the above-identified nut is solidly bonded with the metal plate without being disengageable therefrom, and yet, a sufficiently lengthy tapped hole is formed. Structurally, a nut is formed in the state of being continuous to a metal plate after punching out part of the metal plate. The nut is further punched in order that a punched hole having a diameter narrower than an inner diameter of a tapped hole can be formed in the center of the nut, and finally, the tapped hole is formed in the nut in the manner being coaxial with the punched hole.

1 Claim, 4 Drawing Sheets

SCREW WASHER

This application is a division of application Ser. No. 08/748,735 filed Nov. 18, 1996, which application is now U.S. Pat. No. 5,755,133 which is a division of application Ser. No. 08/115,010 filed Sep. 1, 1993, now U.S. Pat. No. 5,626,521.

BACKGROUND OF THE INVENTION

The present invention relates to a screw washer itself.

FIG. 4 illustrates a pipe clamp used for distributing oil-pressurized pipes or the like in a factory. A lower clamp member 105*a* is mounted on a lower washer 101, and in addition, an upper clamp member 105*b* is mounted on the lower clamp member 105*a*. A top plate 106 is disposed on the upper clamp member 105*b* by way of facing the lower washer 101. A bolt 107 penetrates the top plate 106 and the upper and lower clamp members 105*b* and 105*a* before being secured onto the lower washer 101.

As shown in FIG. 5, the lower washer 101 comprises a metal plate 102 and a positioning nut 103 which projects from the top surface of the metal plate 102. The lower clamp member 105*a* is positioned by internally coupling a positioning hole 105*h* of the lower clamp member 105*a* with the positioning nut 103. A tapped hole 104 corresponding to the bolt 107 is formed in the positioning nut 103.

The above-cited conventional pipe clamp is used for distributing pipe for feeding pressurized oil or air in a factory. However, in many cases, substantial mechanical vibration is transmissible in such a factory cited above, and therefore, it is essential that a substantial amount of torque be provided for fastening the bolt against the metal plate 102. In order to fully strengthen torque enough to fasten the bolt 107, this conventional pipe clamp uses the positioning nut 103 having length $\beta$ being greater than the thickness $\alpha$ of the metal plate 102. Concretely, the positioning nut 103 is formed independent of the metal plate 102. A through-hole 108 is formed in the metal plate 102 by way of penetrating the positioning nut 3, and then, the positioning nut 103 is inserted in the through-hole 108 before eventually brazing them.

In this way, since the conventional lower washer 101 comprises the discretely formed metal plate 102 and the nut 103 which are conjunctionally brazed, the manufacturing process involves a complexity which results in the difficulty to decrease cost. In addition, the brazing finish may be stripped off by an effect of vibration generated by a flow of fluid inside of the pipe clamp. A similar problem also occurs when using the conventional pipe clamp in an iron foundry in a highly-heated atmosphere.

Therefore, as shown in FIG. 6, there is such an idea to execute a method which initially forms a positioning nut 203 by punching out part of a metal plate 202 and then forms a tapped hole 204 in the center of the positioning nut 203.

More particularly, in order to provide the positioning nut 203 with a predetermined peripheral surface form, a die 300 having an aperture 301 having a shape corresponding to the positioning nut 203 is used. In addition, this mold uses a trapezoidal projection 401 having a shorter length than the thickness of the metal plate in a range wider than the projection figure of the positioning nut 203. This mold uses a punch 400 comprising a trapezoidal projection 401 projecting itself by way of the being shallower than the thickness of metal plate in a range wider than the projection figure of the projection nut 203 and a center projection 402 which further protrudes from the center of the trapezoidal projection figure of the nut 203, and yet, the center projection 402 has a diameter wider than that of the tapped hole 204.

The trapezoidal projection 401 is wider than the aperture (recessed domain) 301 of the die 300 to expand the thickness of the positioning nut 203 which is formed by expanding a volume of the extruded part. Nevertheless, in order to maximize bonding strength between the positioning nut 203 and the metal plate 202, a certain volume is needed for the projection between the metal plate 202 and the positioning nut 203, and thus, a thickness of the positioning nut 203 cannot practically be expanded contrary to expectation, and thus, it results in the short length of the tapped hole 204 formed in the positioning nut 203.

For example, assume that a minimum of 4.8 mm of nominal height (as per JIS-B1181) of a nut available for a screw having 6 mm of nominal diameter "d", a minimum of 120 kgf/cm of bolt-fastening torque (as per JIS-B1052), and a minimum of 1.6 metric ton of peripheral tensile shearing force (as per JIS-B1051), are compulsorily demanded. In this case, even when forming the positioning nut 203 from a steel plate having 4.5 mm of thickness as per JIS and ISO standards to replace the positioning nut satisfying the above requirements, if the requirements for the bolt-fastening torque and the peripheral tensile shearing force were fully satisfied, then, it conversely contracts the thickness of the positioning nut 203 below 4.8 mm. Conversely, if a minimum of 4.8 mm of thickness were provided for the positioning nut 203, then, it will cause the juncture $\gamma$ to become abnormally thin, thus failing to satisfy the above requirements prescribed for the bolt-fastening torque and the peripheral tensile shearing force.

On the other hand, there is another idea of directly forming a female screw on a 6 mm-thick steel plate conforming to JIS and ISO standards surpassing the JIS and ISO standards prescribing 4.5 mm of the steel-plate thickness. Nevertheless, in this case, substantially 5 mm of diameter is needed for the bottom hole. If the bottom hole having a narrower diameter than an thickness were punched out by means of a punch, then, it will incur an excessive load to the punch beyond tolerance. Instead, there is an idea of boring a bottom hole by applying a drilling machine. Nevertheless, this requires much operating time and processing work.

SUMMARY OF THE INVENTION

Therefore, the invention has been achieved to fully solve those technical problems incidental to making screw washers. The primary object of the invention is to form an improved screw washer incorporating a nut satisfying the required height by means of a metal plate having a thickness less than the nominal height required for the nut. The secondary object of the invention is to provide an improved screw washer that can easily be fabricated via a mold and prevent the formed nut from being disengaged from the metal plate by virtue of a solid bonding between them. Furthermore, the secondary object of the invention is to provide an improved screw washer and an improved mold for fabricating the improved screw washer.

To achieve the above objects, the invention introduces those novel means described in FIGS. 1, 2, 3*a*, 3*b*, and 3*c*. Concretely, a nut 3 continuous with a metal plate 2 is formed by punching out part of the metal plate 2. Then, a punching hole 7 is formed in the center of the nut 3, where the punching hole having a diameter narrower than an inner diameter of the tapped hole 4. Finally, the tapped hole 4 is formed in the nut 3 by way of being coaxial with the punching hole 7.

The tapped hole 4 may also be formed after boring a bottom hole 8 by way of being coaxial with the punching hole 7 formed in the nut 3.

To form a screw washer, a die 10 having an aperture 11 corresponding to an external shape of the nut 3 and a mold comprising a punch 20 for fabricating a screw washer are respectively introduced as shown in FIGS. 3*a*–3*c*. More particularly, the punch 20 comprises a projection 21 projecting itself by way of being shallower than the thickness of the metal plate 2 in a range wider than the aperture 11 and a center projection 23 which protrudes from the center of the projection 21 and has a diameter narrower than the inner diameter of the tapped hole 4 formed in the center of the nut 3.

The mold for embodying the invention forms the nut 3 having a peripheral-surface shape along an inner peripheral surface of the die 10 by additionally forming a second projection 22 having a diameter narrower than the aperture 11 between the projection 21 and the center projection 23.

The screw nut formed by the above mold comprises a metal plate 2, a nut 3 described below, and a tapped hole 4 which is coaxially formed in alignment with a punched hole 7 formed in the nut 3 by a length corresponding to the thickness of the nut 3. Part of the metal plate 2 is continuously punched out in the nut 3, and yet, a punched hole 7 is formed in the center of the punched domain, where the punched domain 7 has a diameter narrower than that of the tapped hole 4.

The mold according to the invention a shown in FIGS. 3*a*–3*c* has an aperture 11 corresponding to the shape of the nut 3 from which the die 10 is punched out. Since a projection 21 of the punch 20 has a range wider than the aperture 11 of the die 10, by effect of expanding volume of the punched domain of the nut 3 and the continuous domain between the nut 3 and the metal plate 2, the thickness of the nut 3 is expanded. Since a projection 22 in the intermediate step is smaller than the aperture 11 of the die 10, the projection 22 is inserted in the aperture 11, thus forming an external shape of the nut 3.

A projection 23 at a further end causes a volume of the punch to expand itself inside of the aperture 11 of the die 10, and as a result, the thickness of the nut 3 expands.

And yet, after forming the punched hole 7 by means of the central projection having a diameter narrower than the inner diameter of the tapped hole 4 formed in the center of the nut 3, a bottom hole 8 is formed in the nut 3 by way of being coaxial with the punched hole 7 before eventually forming the tapped hole 4 in the bottom hole 8. Since the depth domain of the punched hole 7 can be utilized as the tapped hole, the length of the tapped hole 4 exactly corresponds to the thickness of the nut 3.

DESCRIPTION OF THE PREFERRED EMBODIMENTS

Referring now to the accompanying drawings, embodiments of the invention are described below.

Figure 1:
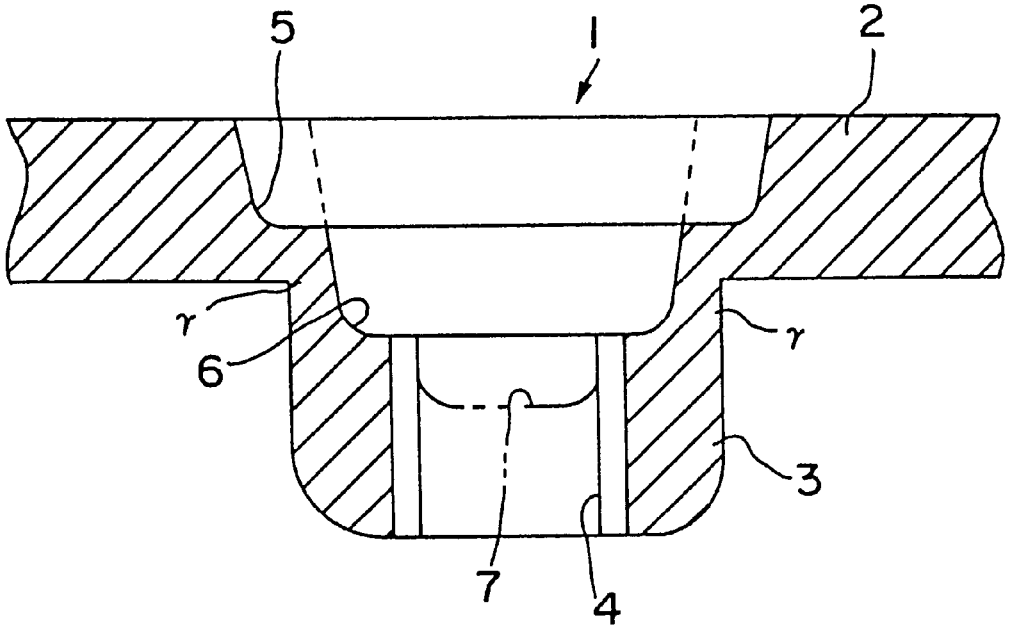
FIG. 1 is a cross-sectional view of the screw washer according to an embodiment of the invention.
Figure 2:
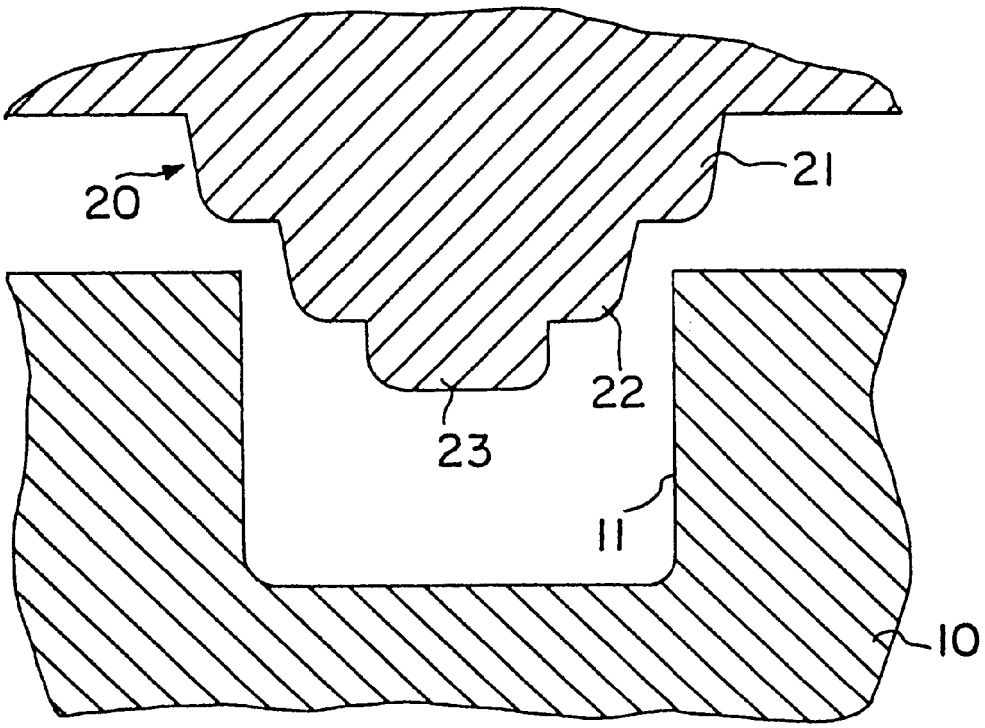
FIG. 2 is a cross-sectional view of the mold for fabricating the screw washer embodied by the invention.
Figure 3A:
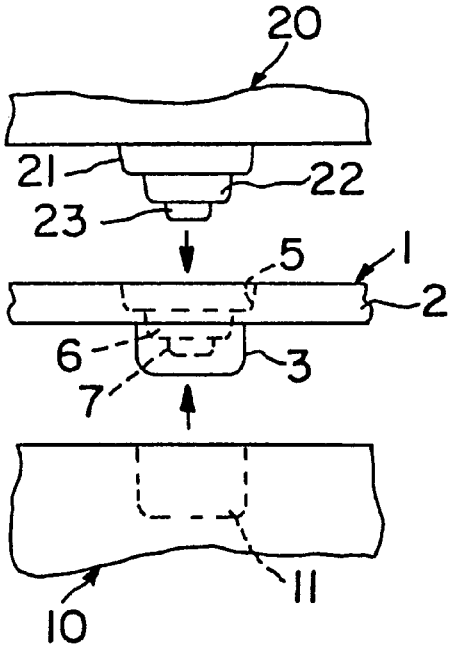
FIGS. 3*a*–3*c* illustrate a flow chart illustrating the steps of manufacturing the screw washer related to the invention.

As shown in FIG. 1, a screw washer 1 according to an embodiment of the invention comprises a metal plate 2, a nut 3 which is formed by punching out part of the metal plate 2, and a tapped hole 4 formed in the center of the nut 3. As shown in FIG. 3*a*, the nut 3 is punched out of the metal plate 2 by a mold comprising a die 10 and a punch 20 shown in FIG. 2. Concretely, the die 10 has an aperture 11 (the aperture 11 may be bottomed or of through-hole) corresponding to an external peripheral form of the nut 3 to be punched out.

The punch 20 incorporates a projection 21 projecting itself by way of being shallower than a thickness of the metal plate 2 in a range wider than the aperture 11, a second projection 22 having a diameter wider than the tapped hole 4 in a range narrower than the aperture 11 from the center of the projection 21, and a central projection 23 projecting itself from the center of the second projection and having a diameter narrower the inner diameter of the tapped hole 4.

The first projection 21 is wider than the aperture 11 of the die 10, and therefore, a certain volume greater than the volume (indicated by a broken line shown in FIG. 1) to be punched out by the second projection 22, thus expanding the thickness of the nut 3. It should be noted however that, since there is no projection corresponding to the die 10, even when providing the first projection 21 with a substantial diameter, punching cannot sufficiently be executed. Conversely, if the diameter of the first projection 21 were contracted to be close to that of the aperture 11 of the die 10, then, it will diminish tensile shearing force in the circumferential domain. Therefore, the diameter of the first projection 21 can be expanded by 10 through 30% against the aperture 11 of the die 10.

In order to integrate the nut 3 with the metal plate 2 with sufficient bonding strength, it is essential that the height of the first projection 21 be of a specific value thinner than the thickness of the metal plate 2. If the projection 21 were provided with an excessive height, then, it cannot be integrated with the metal plate 2 with sufficient bonding strength. Conversely, if the thickness of the metal plate 2 were too thin, then, it will diminish the volume to be punched out, and as a result, the nut 3 will not be able to generate substantial strength contrary to expectations. Therefore, it is suggested that the height of the first projection 21 shall range from 50% to 75% against the actual thickness of the metal plate 2. The suggested range is also dependent on the thickness of the metal plate 2. It should be noted that the description assumes the case of using a metal plate 2 comprising a steel plate having a thickness thinner than the diameter of the bottom hole 8, and yet, having the largest thickness among those which are specified in JIS and ISO standards against the thickness demanded for the nut 3.

In order to facilitate penetration of the first projection 21 into the metal plate 2, the external circumference of the projection 21 is tapered by 5 through 10 degrees.

The second projection 22 is narrower than the aperture 11 of the die 10. Therefore, after inserting the second projection 22 into the aperture 11 of the die 10, the nut 3 having an outer diameter identical to the inner diameter of the aperture 11 can eventually be formed. If the diameter of the second projection 22 were too close to the diameter of the aperture 11 of the die 10, then, it will generate a thin juncture $\gamma$ between the metal plate 2 and the nut 3 to diminish the strength needed for bonding the metal plate 2 with the nut 3. It is essential that the bonding strength between these be greater than the tensile shearing force in the circumferential domain mentioned earlier. Conversely, if there were too large a difference between the diameters of the second projection 22 and the die 10, then, it will contract the volume that should be punched out, thus eventually contracting the thickness of the nut 3.

In consideration of the above requirements, the difference between the diameters of the second projection 22 and the aperture 11 of the die 10 is specified to be 50% through 75% of the thickness of the metal plate 2. This range is also dependent on the thickness of the metal plate 2. This description assumes the case of using a metal plate 2 composed of a steel plate having a thickness thinner than the diameter of the bottom hole 8, and yet, having the largest thickness among those which are specified in JIS and ISO standards against the thickness demanded for the nut 3.

In the same way as is provided for the external circumferential surface of the first projection 21, the external circumference of the second projection 22 is also tapered by 5 through 10 degrees.

Figure 3B:
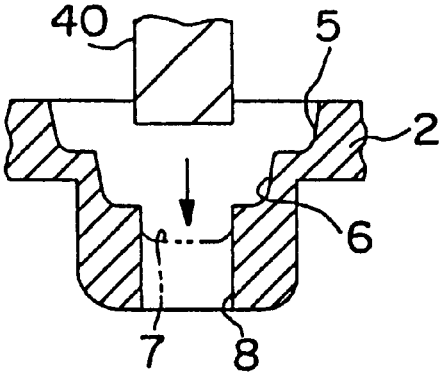

The central domain 23 at the tip domain has a diameter narrower than the inner diameter of the tapped hole 4. This in turn permits further extension of height of the nut 3 punched out by the first and second projections 21 and 22. On the other hand, since the punched hole 7 formed by the central projection 23 has a diameter narrower than that of the tapped hole 4 as mentioned below, therefore, the expanded thickness of the nut 3 can be used for the length of the tapped hole 4. After punching out the nut 3, as shown in FIG. 3*b*, using a punch 40 for example, the bottom hole 8 having a diameter narrower than the inner diameter of the tapped hole 4 open to the tip surface of the nut 3 can be formed in the state being coaxial with the punched hole 7. A drill may also be used. However, use of the punch 40 simplifies the manufacturing work with less operating steps.

There is no sizewise restriction between diameters of the bottom hole 8 and the punched hole 7. However, it is a conventional practice to provide a diameter of the punched hole 7 to be identical to or narrower than that of the bottom hole 8.

When executing this method, in order to promote positional accuracy of the bottom hole 8 and contract operating time needed for boring it, a diameter of the bottom hole 8 is identical to that of the punched hole 7.

Figure 3C:
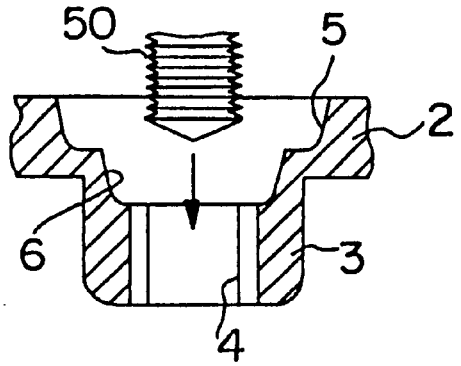
Figure 4:
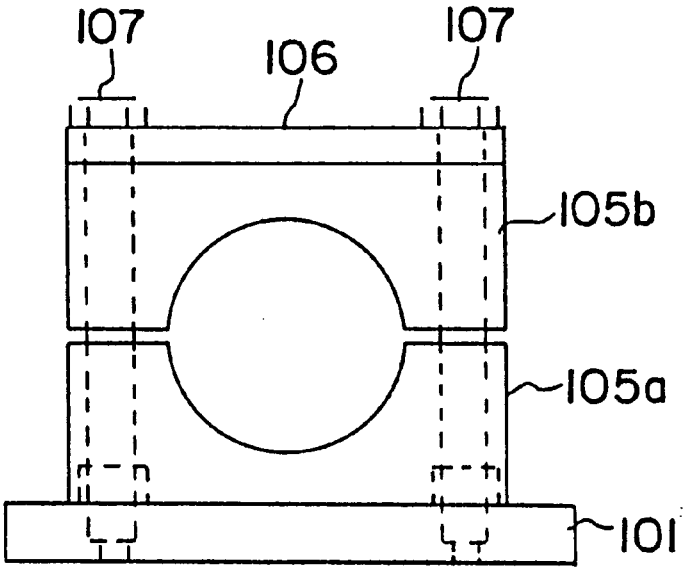
FIG. 4 PRIOR ART
FIG. 4 is a front view of a pipe clamp built with conventional components.
Figure 5:
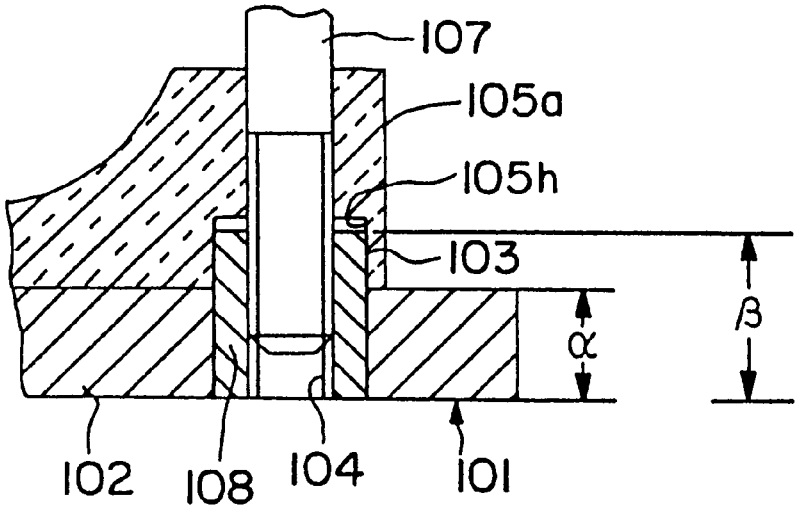
FIG. 5 PRIOR ART
FIG. 5 is a cross-sectional view of a conventional screw washer.
Figure 6:
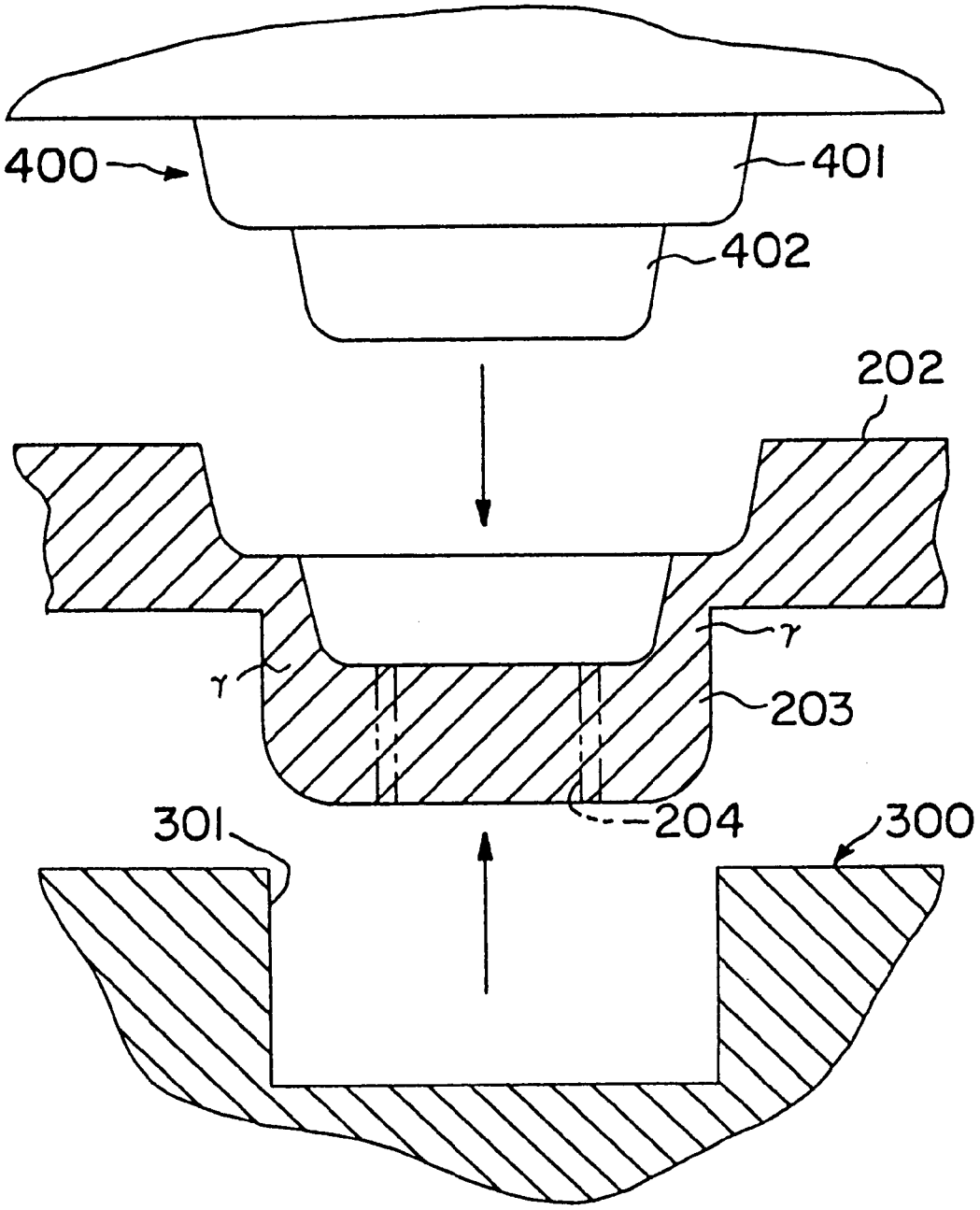
FIG.6 PRIOR ART
FIG. 6 is an exploded sectional view of a conventional screw washer.

Then, as shown in FIG. 3*c*, initially, a tap 50 is vertically inserted from the top surface of the nut 3 into the bottom hole 8 to effect threading. Although it is not essential for the invention to form the bottom hole 8, since the threading operation can be executed via the bottom hole 8 and the punched hole serving as a guide, a threading operation can easily be done, and yet, the tapped hole 4 can accurately be formed without being inclined, and the bottom hole 8 provides a substantial advantage.

In this way, the nut 3 is formed by punching out part of the metal plate 2 by utilizing the mold described above, and then, the tapped hole 4 is formed in the center of the nut 3 before eventually completing the screw washer shown in FIG. 1.

As a result of a trial application of the invention to the formation of the nut 3 used for a screw having d=6 mm of nominal diameter by punching out a metal plate 2 having a thickness, of about 4.5 mm inventors have confirmed the results shown below.

1: The nut 3 having a thickness of 5.5 mm: This proved to have cleared a thickness of 4.8 mm prescribed by JIS-B1181.

2: A minimum bolt-fastening torque: of 200 kgf/cm This proved to have cleared a bolt-fastening torque of 120 kgf/cm prescribed by JIS-B-1052.

3: A minimum of 2.6 metric tons of tensile shearing force in a circumferential domain:

This proved to have cleared a tensile shearing force of 1.6 metric ton prescribed by JIS-B1051.

Note that the above trials were executed as per those dimensional conditions shown below.

Diameter of the aperture 11 of the die 10: 12 mm

Diameter of the first projection 21: 14 mm

Note that, because of the tapered structure, the top-end domain of the projection 21 had more than 14 mm of diameter.

Height of the first projection 21: 3.0 mm

Diameter of the second projection 22: 9.7 mm

Note that, because of the tapered structure, the bottom-end domain of the second projection 22 had less than 9.7 mm of diameter.

Height of the second projection 22: 2.5 mm

Diameter of the central projection 23: 5.1 mm

Height of the central projection 23: 2.0 mm

As described above, since the nut 3 is formed by punching out part of the metal plate 2, unlike any conventional screw washer comprising the metal plate 102 and the nut 103 which are discretely formed in the initial step followed by execution of a brazing process, the screw washer 1 according to the invention can simplify the fabricating process, thus sharply decreasing cost, and yet, promoting actual yield rate of material.

Furthermore, according to the screw washer 1 embodied by the invention, since the nut 3 is formed by punching out part of the metal plate 2, the nut 3 itself is systematically a continuous metal plate 2. Therefore, the metal plate 2 is solidly bonded with the nut 3. This in turn promotes a fatigue strength against mechanical vibration. In consequence, the nut 3 is totally free from fear of being disengaged from the metal plate 2 during its service life, thus significantly promoting reliability on the durable strength of the products.

Furthermore, according to the screw washer 1 embodied by the invention, since the screw of the tapped hole 4 is formed all over the thickness of the center domain of the nut 3 being thicker than the metal plate 2, the mold used to carry out the invention can form the tapped hole 4 having a length needed for obtaining a substantial strength for coupling the tapped hole 4 with the engageable bolt.

Furthermore, according to the invention, since the nut 3 having the predetermined thickness can securely be formed using a metal plate 2 being thinner than the height demanded for the nut 3, material cost can be decreased.

The above description of the invention has solely referred to the case in which the nut 3 has a circular external circumference, it should be understood however that the scope of the invention is also applicable to such a conventionally shaped nut like the one having hexagonal shape as well.

As is clear from the above description, according to the mold for fabricating the screw washer 1 embodied by the invention, the mold can continuously form a quality nut 3 having the predetermined external circumferential shape and a punched hole 7 at the center thereof, where the punched hole 7 has a diameter narrower than the inner diameter of the tapped hole 4. Therefore, fatigue strength at the juncture of the nut 3 and the metal plate 2 against mechanical vibration is promoted. As a result, there is no fear of causing the nut 3 to be disengaged from the metal plate 2, thus significantly promoting reliability on the durable strength of the eventual products.

By virtue of the formation of a tapped hole at the center of the nut formed by execution of the above processes in a range from the tip of the punched surface of the nut to the punched hole, the mold for embodying the invention can properly form a tapped hole having a screw longer than the thickness of the metal plate, thus securely promoting the bonding strength between the tapped hole and the bolt engaged therewith.

What is claimed is:

1. A screw washer comprising a metal plate (2) which forms a washer portion (1) and a nut portion (3), said nut portion being formed by a punched out portion of said metal plate which forms a blind aperture in said washer portion and said nut portion, said blind aperture includes first, second and third sections of different diameters, said nut portion includes an axial threaded aperture and an outer circumferential surface which has a length greater than a thickness of said washer portion, said first diameter section of said blind aperture extends into said threaded aperture and has a diameter substantially the diameter of said threaded aperture, said second diameter section of said blind aperture has a diameter which is greater than said first diameter section but less than the outer circumference of said nut section and has a portion extending into said nut portion and a portion incorporated within said washer portion, and said third diameter section of said blind aperture has a diameter which is greater than said second diameter section of said blind aperture beginning at an upper surface of said metal plate and has a height which is at least 50% of the thickness of said metal plate.

* * * * *